US012742278B2

(12) United States Patent
Xu et al.

(10) Patent No.: US 12,742,278 B2
(45) Date of Patent: Sep. 22, 2026

(54) CONTROL METHOD FOR WASHING MACHINE AND WASHING MACHINE

(71) Applicants: Qingdao Haier Washing Machine Co., Ltd., Shandong (CN); Haier Smart Home Co., Ltd., Shandong (CN)

(72) Inventors: Sheng Xu, Shandong (CN); Yanfen Lv, Shandong (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 175 days.

(21) Appl. No.: 18/701,518

(22) PCT Filed: Sep. 30, 2022

(86) PCT No.: PCT/CN2022/123100
§ 371 (c)(1),
(2) Date: Apr. 15, 2024

(87) PCT Pub. No.: WO2023/061246
PCT Pub. Date: Apr. 20, 2023

(65) Prior Publication Data

US 2024/0401259 A1 Dec. 5, 2024

(30) Foreign Application Priority Data

Oct. 14, 2021 (CN) ..... 202111199095.0

(51) Int. Cl.
*D06F 39/10* (2006.01)
*D06F 23/02* (2006.01)
(Continued)

(52) U.S. Cl.
CPC ..... *D06F 39/10* (2013.01); *D06F 23/02* (2013.01); *D06F 33/37* (2020.02); *D06F 39/02* (2013.01);
(Continued)

(58) Field of Classification Search
CPC ..... D06F 23/02; D06F 33/37; D06F 39/02; D06F 39/10; D06F 39/085; D06F 2105/06; D06F 2105/34; D06F 2105/42
See application file for complete search history.

(56) References Cited

U.S. PATENT DOCUMENTS 5,595,072 A 1/1997 Bai et al.
2009/0172892 A1* 7/2009 Oh ..... D06F 39/40 8/149.1
2016/0194807 A1* 7/2016 Stabon ..... F03C 1/0671 68/17 R

FOREIGN PATENT DOCUMENTS

CN 102433710 A 5/2012
CN 104452171 A 3/2015
(Continued)

OTHER PUBLICATIONS

Machine translation of WO 2014-079253 A1 to Hao et al. (Year: 2014).*
(Continued)

*Primary Examiner* — Joseph L. Perrin
(74) *Attorney, Agent, or Firm* — Panitch Schwarze Belisario & Nadel LLP

(57) ABSTRACT

A control method for a washing machine and a washing machine. The washing machine includes: a water tank having a circulating filter pipeline, a water inlet end and a water outlet. A circulation pump and a filtering device are arranged on the water tank. A filtering device includes a filtering cavity. A filtering mechanism is rotatably arranged inside the filtering cavity. The control method includes:
(Continued)

delivering clothes treatment agent into the water tank; turning on the circulation pump to circulate the water in the water tank through the filtering device; controlling the filtering mechanism to rotate in the filtering cavity at a first speed to dissolve the clothing treatment agent in the water. The filtering device of the present disclosure itself has the function of removing lint in the water, after the clothes treatment agent is delivered, it can also rotate through the filtering mechanism to stir the water flow.

11 Claims, 5 Drawing Sheets

(51) Int. Cl.

| | |
|---|---|
| ***D06F 33/37*** | (2020.01) |
| ***D06F 39/02*** | (2006.01) |
| ***D06F 39/08*** | (2006.01) |
| *D06F 105/06* | (2020.01) |
| *D06F 105/34* | (2020.01) |
| *D06F 105/42* | (2020.01) |

(52) U.S. Cl.
CPC ..... *D06F 39/085* (2013.01); *D06F 2105/06* (2020.02); *D06F 2105/34* (2020.02); *D06F 2105/42* (2020.02)

(56) References Cited

FOREIGN PATENT DOCUMENTS

| | | | | | |
|---|---|---|---|---|---|
| CN | 105088642 | A | * | 11/2015 | ..... D06F 58/45 |
| CN | 105350236 | A | | 2/2016 | |
| CN | 106757957 | A | | 5/2017 | |
| CN | 108691153 | A | | 10/2018 | |
| CN | 109957937 | A | | 7/2019 | |
| GB | 609091 | A | | 9/1948 | |
| JP | H06134182 | A | | 5/1994 | |
| JP | 2016013222 | A | | 1/2016 | |
| JP | 2017522913 | A | | 8/2017 | |
| KR | 970000048 | B1 | * | 1/1997 | ..... D06F 39/028 |
| WO | WO-2014079253 | A1 | * | 5/2014 | ..... D06F 39/083 |

OTHER PUBLICATIONS

Machine translation of JP 2016-013222 A to Wakita et al. (Year: 2016).*
Machine translation of KR 1997-0000048 B1 to So. (Year: 1997).*
Machine translation of CN 105088642 A to Xu et al. (Year: 2015).*
International Search Report and Written Opinion issued Jan. 3, 2023 in PCT/CN2022/123100 (translation of ISR only).
Extended European Search Report issued on Jun. 24, 2025, by the European Patent Office in corresponding EP Application No. 22880185.8 (4 pages).
Office Action issued on May 27, 2025, by the Japanese Patent Office in corresponding JP Application No. 2024-522195, and English translation of the Office Action (8 pages).

* cited by examiner

CONTROL METHOD FOR WASHING MACHINE AND WASHING MACHINE

CROSS-REFERENCE TO RELATED APPLICATIONS

This application is a Section 371 of International Application No PCT/CN2022/123100, filed Sep. 30, 2022, which was published in the Chinese language on Apr. 20, 2023, under International Publication No. WO 2023/061246 A1, which claims priority under 35 U.S.C. § 119(b) to Chinese Application No. 202111199095.0, filed Oct. 14, 2021, the disclosures of each of which are incorporated herein by reference.

TECHNICAL FIELD

The disclosure belongs to the technical field of washing machines, and specifically relates to a control method for a washing machine and a washing machine.

BACKGROUND

In the prior art, the general structure of a drum washing machine is to provide a water tank drainage pipe at the lowest part of the water tank for connecting to a drainage pump to achieve outward drainage. The water tank drainage pipe is generally a hose, has a certain volume, and can accommodate a certain amount of water. When the drum washing machine is working, the laundry treatment agent is flushed into the outer drum by the incoming water flow. If it is not fully dissolved, it will be flushed into the space inside the drain pipe of the water tank. It will be difficult to continue to dissolve and dissolve during the subsequent washing process. If the clothes come into contact, they will be directly drained away with the drainage water during drainage, causing waste.

Most of the current drum washing machines first add a certain amount of water into the water tank, so that the drain pipe of the water tank is filled with water before adding the laundry treatment agent, thereby reducing the accumulation of undissolved clothing treatment agent in the drain pipe of the water tank. However, granular washing powder cannot be fully dissolved in a short period of time and will still sink due to gravity, causing some undissolved washing powder particles to fall into the drain pipe of the water tank. This will cause the actual concentration of washing powder during the washing process to be low, affecting the cleaning effect of the clothes.

Chinese patent application number 201210497315.2 discloses a control method for a drum washing machine with agitated water flow, which includes the following steps: S10: detect whether the water level in the washing machine barrel has dropped; S20: detect whether the distribution of water-filled clothes in the drum is balanced, and determine the eccentricity amount; S30: the inner drum accelerates to the first preset speed, stirring up the water flow at a speed greater than the normal washing speed, and the water and washing powder in the drainage hose are taken out and flow back into the washing machine drum; S40: repeat the steps S30 N times, the water and washing powder in the drainage hose are repeatedly taken out and returned, so that the washing powder is fully and evenly dissolved into the water; S50: the inner drum rotates at the normal washing speed and starts washing.

However, in the above solution, the dissolution effect of the washing powder is improved by controlling the rotation of the inner drum. However, since there is a large amount of water and clothes in the inner drum, the eccentricity needs to be detected to prevent large vibrations during rotation. On the other hand, the inner drum drives the clothes and water in the drum to rotate together. Because the overall mass is too large, it is easy for the motor to stall.

In view of this, the present disclosure is proposed.

SUMMARY

The technical problem to be solved by the present disclosure is to overcome the deficiencies of the prior art and provide a control method for a washing machine and a washing machine. The washing machine is provided with a circulating filter pipeline with a filtering device. After the clothing treatment agent is delivered, the circulation pump can be turned on. The water in the water tank is driven to continuously circulate through the filtering device, and the rotation of the filtering mechanism in the filtering device is controlled to enhance the agitation of the water flow, which in turn allows the clothing treatment agent in the water to be dissolved faster and more fully, which is beneficial to improving the cleaning effect of the clothes.

In order to solve the above technical problems, the basic concept of the technical solution adopted by the present disclosure is:

A control method for a washing machine, the washing machine includes:

a water tank;

a circulating filter pipeline, a water inlet end and a water outlet end of the circulating filter pipeline are communicated to the water tank respectively, and a circulation pump and a filtering device are installed on the circulating filter pipeline;

the filtering device includes, a filtering cavity with a water inlet and a filtered water outlet;

a filtering mechanism is rotatably installed inside the filtering cavity to filter water entering the filtering cavity;

wherein, the control method including:

delivering a laundry treatment agent into the water tank;

turning on the circulation pump to circulate the water in the water tank through the filtering device;

controlling the filtering mechanism to rotate in the filtering cavity at a first set speed to dissolve the laundry treatment agent in the water.

Further, the filtering mechanism continues to rotate at the first set speed for a preset time, and then the filtering mechanism is controlled to stop rotating.

Further, after the filtering mechanism stops rotating, the circulation pump remains operating state and the washing machine performs a circulation filtering washing/rinsing.

Further, after washing/rinsing is completed, the filtering mechanism is controlled to rotate in the filtering cavity at a second set speed to remove filtered impurities on a surface of the filtering mechanism; the first set speed is greater than the second set speed;

preferably, the first set rotation speed is 100~800 rpm.

Further, the washing machine determines the first set speed according to washing parameters in the currently operating washing program;

preferably, the washing parameters include a water temperature in the water tank and/or whether the washing machine turns on a heating function;

more preferably, the first set speed decreases as the water temperature in the water tank increases;

and/or, the first set speed decreases when the washing machine turns on the heating function.

Further, wherein the washing machine determines a preset duration according to the washing parameters in the currently operating washing program;

preferably, the washing parameters include a water level in the water tank, and/or the water temperature in the water tank, and/or whether the washing machine turns on the heating function;

more preferably, the preset duration is extended as the water level in the water tank increases;

and/or, the preset duration shortens as the water temperature in the water tank increases;

and/or, the preset duration is shortened when the washing machine turns on the heating function.

Further, before turning on the circulation pump, the step further includes: if the water level in the water tank is greater than the preset water level, then turn on the circulation pump, otherwise turned on the circulation pump after the water level in the water tank reaches the preset water level.

Further, the filtering device further includes a driving mechanism, the driving mechanism is connected to the filtering mechanism and is used to drive the filtering mechanism to rotate in the filtering cavity;

after turning on the circulation pump, the washing machine determines the first set speed according to the washing parameters in the currently operating washing program;

the driving mechanism is turned on to drive the filtering mechanism to rotate at the first set speed.

Another object of the present disclosure is to provide a washing machine that adopts the above-mentioned control method of the washing machine.

Furthermore, cleaning particles are provided in the filtering cavity for friction and collision with the movement of water flow to accelerate the dissolution of the clothing treatment agent.

After adopting the above technical solution, the present disclosure has the following beneficial effects compared with the prior art.

In the present disclosure, the filtering device can circulate and filter the water in the water tank during the washing process, thereby removing filter impurities such as lint in the water and improving the washing effect of the clothes. After adding the clothes treatment agent, start the circulation pump to transport the water in the water tank to the filtering device, and control the rotation of the filtering mechanism at the same time, which can strengthen the agitation of the water flow inside the filtering device, so that the clothes treatment agent in it can be more fully and evenly dissolved in the water, and then transporting it back to the water tank will help speed up the dissolution of the laundry treatment agent, improve the utilization rate of the laundry treatment agent, and thereby improve the laundry effect. The integrated filtering device can realize two different functions, saving the space inside the washing machine.

In the present disclosure, the washing machine adjusts the rotation speed and rotation time of the filtering mechanism according to the laundry parameters, so that the laundry treatment agent can be fully dissolved as quickly as possible under the current laundry parameters, thereby ensuring the working efficiency of the washing machine and saving the washing time of the washing machine.

In the present disclosure, the washing machine controls the circulation pump to turn on after the water level in the water tank reaches the preset water level to prevent the water in the water tank from being too small and air being sucked into the circulation pump to produce operating noise.

In the present disclosure, cleaning particles are provided inside the filtering cavity, and the cleaning particles move with the water flow. On the one hand, the inner wall of the filtering cavity and the outer wall of the filtering mechanism can be cleaned through friction and collision during the cyclic filtration process, preventing the filtering device from being blocked due to the deposition of filter impurities, and affecting the filtration efficiency. On the other hand, the process of dissolving the laundry treatment agent can also further strengthen the agitation intensity of the water flow in the filtering cavity, further accelerating the dissolution efficiency of the laundry treatment agent.

Specific embodiments of the present disclosure will be described in further detail below with reference to the accompanying drawings.

BRIEF DESCRIPTION OF THE DRAWINGS

The drawings, as part of the present disclosure, are used to provide a further understanding of the present disclosure. The schematic embodiments of the present disclosure and their descriptions are used to explain the present disclosure, but do not constitute an improper limitation of the present disclosure. Obviously, the drawings in the following description are only some embodiments. For those of ordinary skill in the art, other drawings can be obtained based on these drawings without exerting creative efforts. In the attached drawings.

Figure 1:
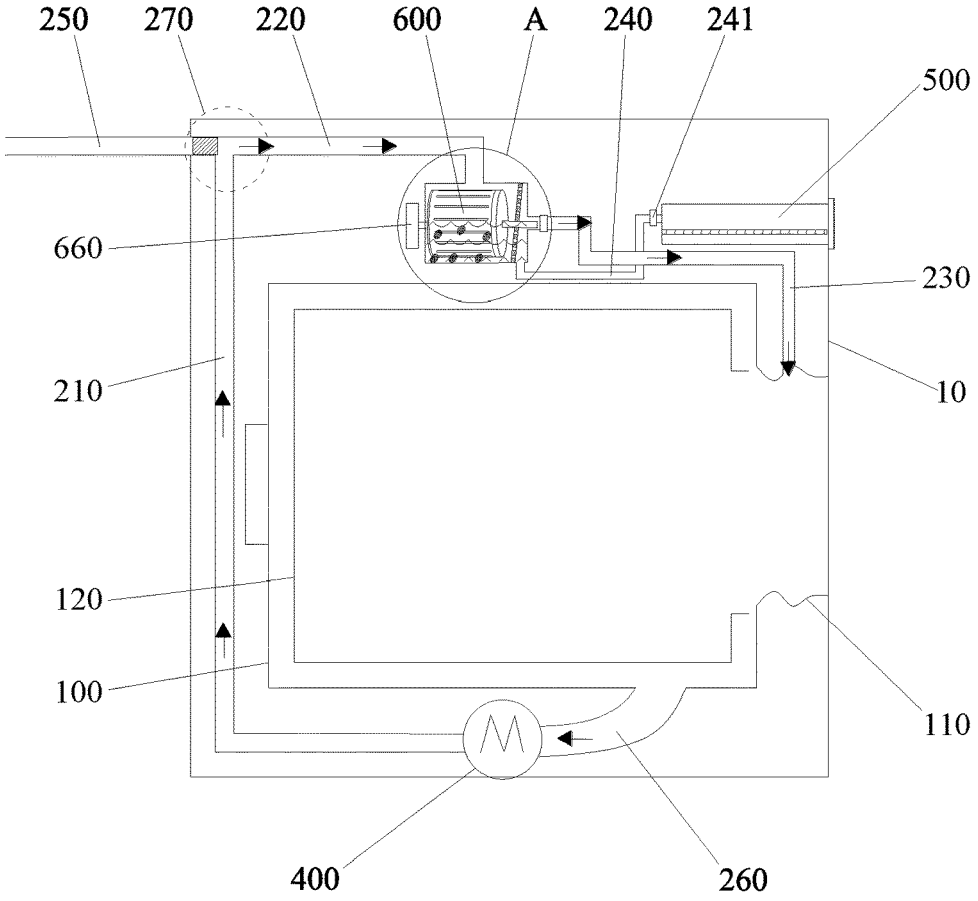
FIG. 1 is a structural diagram of a washing machine in an embodiment of the present disclosure.

In the drawings: 10. box body; 100. water tank; 110. window gasket; 120. drum; 210. drainage pipeline; 220. circulation pipeline; 230. return water pipeline; 231. return water control valve; 240. sewage pipeline; 241. sewage control valve; 250. discharge pipeline; 260. water tank drainage pipe; 270. switching device; 400. circulation pump; 500. recovery device; 501. filter impurities; 510. housing; 520. filter component; 531. first chamber; 532. second chamber;

600. filtering device; 601. first limiting surface; 602. second limiting surface; 603. third limiting surface; 604. fourth limiting surface; 605. fifth limiting surface; 606. sixth limiting surface; 610. filtering cavity; 6101. water inlet; 6102. filtered water outlet; 6103. sewage outlet; 6104. installation opening; 611. sealing support part; 612. sleeve part; 613. reinforcing rib; 620. filtering mechanism; 621.

water outlet joint; 622. rotating support part; 623. filter support part; 624. motor mounting part; 625. filter screen; 631. first bearing; 632. second bearing; 641. first seal; 642. second seal; 643. third seal; 650. filtering cavity flange; 651. connection part; 652. insertion part; 653. through port; 660. driving mechanism; 680. cleaning particles; 690. blocking plate; 691. water hole; 692. through hole.

It should be noted that these drawings and text descriptions are not intended to limit the scope of the disclosure in any way, but are intended to illustrate the concept of the disclosure for those skilled in the art by referring to specific embodiments.

DETAILED DESCRIPTION

In order to make the purpose, technical solutions and advantages of the embodiments of the present invention clearer, the technical solutions in the embodiments of the present invention will be clearly and completely described below in conjunction with the drawings in the embodiments of the present invention. The following examples are used to illustrate the present invention, but are not used to limit the scope of the present invention.

In the description of the present invention, it should be noted that the terms "upper", "lower", "left", "right", "vertical", "inner", "outer", etc. indicate an orientation or positional relationship based on the orientation or positional relationship shown in the drawings is only to facilitate the description of the present invention and simplify the description, and does not indicate or imply that the device or element referred to must have a specific orientation, be constructed and operated in a specific orientation, and therefore cannot be understood as limitations on the invention.

In the description of the present invention, it should be noted that, unless otherwise clearly stated and limited, the terms "installation" and "connection" should be understood in a broad sense. For example, it can be a fixed connection, a detachable connection, or an integral connection; it can be directly connected or indirectly connected through an intermediary. For those of ordinary skill in the art, the specific meanings of the above terms in the present invention can be understood on a case-by-case basis.

Embodiment 1

Figure 2:
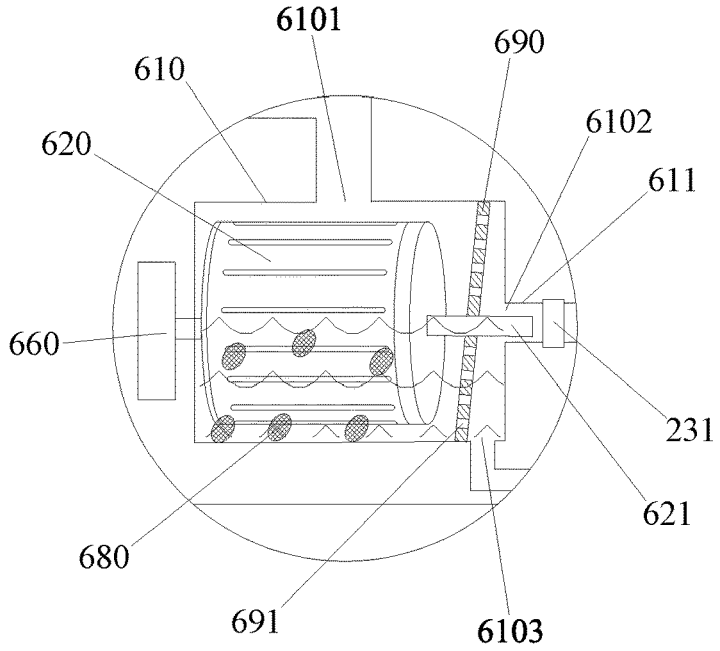
FIG. 2 is an enlarged schematic diagram of position A in FIG. 1 of the present disclosure.

As shown in FIGS. 1 and 2, the washing machine described in this embodiment includes:

- a water tank 100;
- a circulating filter pipeline, the water inlet end and the water outlet end of which are respectively connected with the water tank 100, on which a circulation pump 400 and a filtering device 600 are arranged.

In this embodiment, the filtering device 600 is disposed between the water outlet end of the circulation pump 400 and the water outlet end of the circulating filter pipeline. The filtering device 600 specifically includes:

- a filtering cavity 610, which has a water inlet 6101 and a filtered water outlet 6102;
- a filtering mechanism 620, which is rotatably arranged inside the filtering cavity 610 to filter the water entering the filtering cavity 610.

Specifically, a water tank drainage pipe 260 is provided on the water tank 100 and is connected to the water inlet end of the circulation pump 400. The water outlet end of the circulation pump 400 is connected to the drainage pipeline 210. The drainage pipeline 210 is in turn connected to the circulation pipeline 220. The water outlet end of the circulation pipeline 220 is connected with the water inlet 6101 of the filtering device 600. When the circulation pump 400 is turned on, the water in the water tank 100 enters the filtering device 600 through the water tank drainage pipe 260, the drainage pipeline 210 of the circulation pump 400 and the circulation pipeline 220 in sequence.

The filtered water outlet 6102 of the filtering device 600 is used to discharge filtered water, and is connected to the water tank 100 through a return water pipeline 230. The return water pipeline 230 is specifically connected to the window gasket 110 at the opening of the water tank 100. The return water pipeline 230 is also provided with a return water control valve 231 for controlling the opening and closing of the return water pipeline 230.

It can be understood that a water return port can also be provided on the wall of the water tank, and the outlet end of the return water pipeline is connected to the water return port to directly return water to the water tank.

The washing machine of this embodiment also includes a main water inlet pipeline for connecting an external water source and a water tank. In another solution, the water outlet end of the return water pipeline can also be connected to the main water inlet pipeline, for example, connected to a detergent box on the main water inlet pipe, the filtered water returns to the water tank through the detergent box.

In detail, the filtering mechanism 620 divides the interior of the filtering cavity 610 into an outer cavity and an inner cavity, wherein the water inlet 6101 is connected to the outer cavity, and the filtered water outlet 6102 is connected to the inner cavity. The water in the water tank 100 enters the outer cavity through the water inlet 6101 under the action of the circulation pump 400, and enters the inner cavity through the filtering mechanism 620 to achieve filtration, and the lint carried in the water adheres to the outer wall of the filtering mechanism 620. The return water control valve 231 is in an open state, and the filtered water is finally discharged from the filtered water outlet 6102 and returns to the water tank 100 through the return water pipeline 230.

Figure 3:
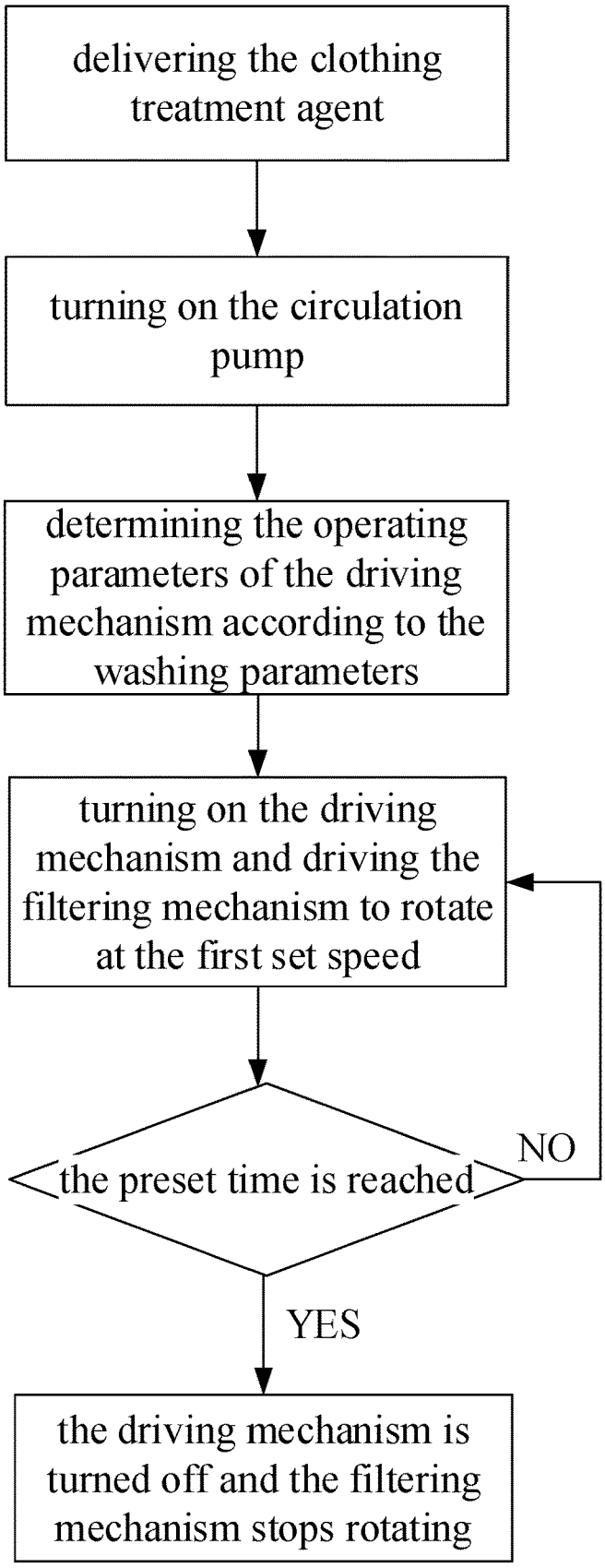
FIG. 3 is a flow chart of the control method for the washing machine in Embodiment 1 of the present disclosure.
Figure 4:
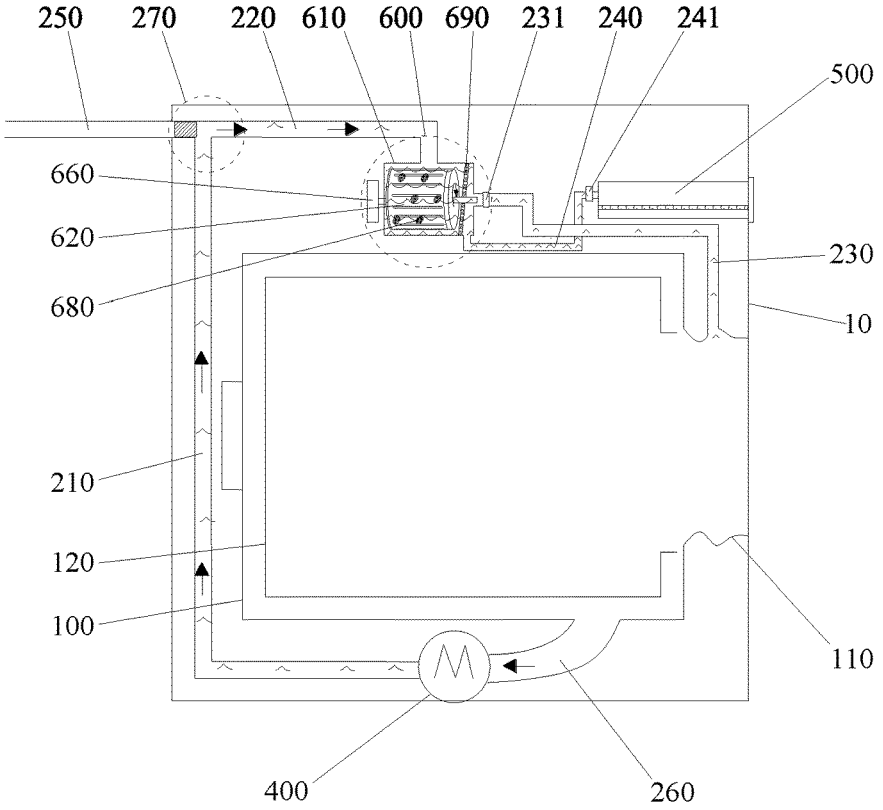
FIG. 4 is a schematic diagram of the washing machine dissolving the laundry treatment agent in Embodiment 1 of the present disclosure.

In this embodiment, in addition to being used for circulating filtration, the filtering device 600 can also assist in the dissolution process of the laundry treatment agent. To this end, as shown in FIGS. 3 and 4, the control method for the washing machine in this embodiment including:

- delivering the laundry treatment agent into the water tank 100;
- turning on the circulation pump 400 to circulate the water in the water tank 100 through the filtering device 600;
- controlling the filtering mechanism 620 to rotate in the filtering cavity 610 at a first set speed to dissolve the laundry treatment agent in the water.

The laundry treatment agent described in this embodiment includes but is not limited to laundry powder, laundry block or laundry detergent used in the washing stage, and softener used in the rinsing stage. Especially for solid laundry detergent or laundry blocks that dissolve slowly in water, the effect of accelerating dissolution is even more significant.

After the clothes treatment agent is delivered into the water tank 100, part of the clothes treatment agent may sink into the inner space of the water tank drainage pipe 260. If washing or rinsing is started directly, this part of the clothes treatment agent cannot be fully dissolved in the water, and thus cannot act on affecting the washing effect.

In this embodiment, after the laundry treatment agent is put in, the circulation pump 400 is turned on, and the return water control valve 231 is in an open state, so that the laundry treatment agent sinking into the water tank drainage pipe 260 can circulate with the water flow and return to the water tank 100. It helps the laundry treatment agent to be more fully and evenly dispersed in the water. At the same time, during the circulation process, the filtering mechanism 620 rotates in the filtering cavity 610, stirring the water in the filtering cavity 610, which is conducive to more fully dissolving the laundry treatment agent in the filtering cavity 610, and then returning to the water tank 100 can speed up the dissolution of the laundry treatment agent and improve the utilization rate of the laundry treatment agent, thereby improving the cleaning effect of the laundry.

The filtering device 600 of this embodiment can be used for circulating filtration of the washing machine, and can also accelerate the dissolution of the clothing treatment agent in water. It realizes two different functions through the same structure, saving the space inside the washing machine. On the other hand, after the filtering device 600 is used for a long time and the filtration effect deteriorates, it can still provide the function of accelerating the dissolution of the laundry treatment agent, thereby preventing the filtering device 600 from being unable to perform any function and wasting space inside the washing machine.

It should be noted that the control method of this embodiment can also be used in other washing equipment that requires the addition of washing reagents, such as care machines, dishwashers, etc.

In this embodiment, the filtering device 600 further includes a driving mechanism 660, which is connected to the filtering mechanism 620 and used to drive the filtering mechanism 620 to rotate in the filtering cavity 610. After the circulation pump 400 is started, the driving mechanism 660 is turned on and the working parameters of the driving mechanism 660 are controlled to drive the filtering mechanism 620 to rotate at the first set speed.

In a further solution of this embodiment, the filtering mechanism 620 continues to rotate at the first set speed for a preset time period, and then the filtering mechanism 620 is controlled to stop rotating.

Further, after the filtering mechanism 620 stops rotating, the circulation pump 400 remains on, and the washing machine performs circulation filter washing/rinsing.

In the above solution, the preset time is the time required to ensure that the laundry treatment agent is fully dissolved. The washing machine controls the rotation time of the filtering mechanism 620, that is, the working time of the driving mechanism 660, and stops the rotation of filtering mechanism 620 after the laundry treatment agent is fully dissolved. When the washing machine enters the washing/rinsing stage, the circulation pump 400 remains on, driving the water in the water tank 100 to circulate through the filtering device 600 for filtering. The filtering mechanism 620 remains stationary during the circulating filtering process, which is conducive to the smooth discharge of filtered water.

In detail, a drum 120 is coaxially arranged in the water tank 100 for holding the laundry. After the filtering mechanism 620 stops rotating, the washing machine controls the drum 120 to rotate at a set rotation/stop ratio to perform laundry washing/rinsing.

In a specific solution of this embodiment, the washing machine determines the value of the preset duration according to the laundry parameters in the currently running laundry program.

The washing parameters include the water level in the water tank 100, and/or the water temperature in the water tank 100, and/or whether the heating function of the washing machine is turned on.

In detail, the value of the preset time length extends as the water level in the water tank 100 increases. The higher the water level, the greater the amount of water contained in the water tank 100, and under the condition that the water circulation flow rate is constant, the longer the time required to fully circulate the water in the water tank 100. At the same time, a higher water level generally corresponds to a larger amount of laundry treatment agent, so the time required for the laundry treatment agent to fully dissolve is longer.

The value of the preset time length shortens as the water temperature in the water tank 100 increases, and the value of the preset time length shortens when the heating function of the washing machine is turned on. In general, the dissolution rate of the laundry treatment agent in water accelerates as the water temperature increases. In this embodiment, the higher the water temperature in the water tank 100 is, the shorter the rotation time can be; and, when the heating function of the washing machine is turned on, the value of the rotation time can be shorter than when the heating function is not turned on.

In the above solution, the rotation time of the filtering mechanism 620 is controlled by the laundry parameters. On the premise of ensuring that the laundry treatment agent is fully dissolved in the water, the process of dissolving the laundry treatment agent is shortened as much as possible, which helps to shorten the time of the washing machine. The overall running time of a laundry program improves user experience.

In this embodiment, the washing machine performs a self-cleaning operation after washing/rinsing, including: closing the return water control valve 231, controlling the filtering mechanism 620 to rotate in the filtering cavity 610 at the second set speed, and cleaning the filtered impurities on the surface of the filtering mechanism 620.

Specifically, the driving mechanism 660 is turned on to drive the filtering mechanism 620 to rotate, so that filtered impurities such as lint and other impurities attached to the outer wall of the filtering mechanism 620 are peeled off from the outer wall of the filtering mechanism 620 under the action of centrifugal force. At this time, since the return water control valve 231 is closed, the water in the filtering cavity 610 does not flow out from the filtered water outlet 6102. The rotating filtering mechanism 620 can also stir the water flow in the filtering cavity 610, and the turbulent water flow formed has an impact on the filtering mechanism 620. The outer wall causes a certain impact force, which can also cause wire chips to fall off. The lint scraps peeled off from the surface of the filtering mechanism 620 are integrated into the water in the filtering cavity 610.

Wherein, the first set rotation speed of the filtering mechanism 620 is greater than the second set rotation speed. For example, the first set speed is 100~800 rpm, and the second set speed is 50~80 rpm.

In a further solution of this embodiment, the washing machine determines the value of the first set rotation speed based on the laundry parameters in the currently running laundry program.

Specifically, the value of the first set rotation speed decreases as the water temperature in the water tank 100 increases, and the value of the first set rotation speed decreases when the heating function of the washing machine is turned on. The faster the rotation speed of the filtering mechanism 620 is, the greater the strength of stirring the water flow, and the more significant the effect of accelerating the dissolution of the laundry treatment agent. Since the dissolution rate of the laundry treatment agent in water increases as the water temperature increases, in this embodiment, the higher the water temperature in the water tank 100 is, the lower the value of the first set rotation speed can be; and, when the washing machine turns on the heating function, the value of the first set speed can be lower than when the heating function is not turned on.

On the premise of ensuring that the laundry treatment agent is dissolved as quickly as possible, the above solution prevents the filtering mechanism 620 from rotating at an excessively high speed, thereby preventing the filtering mechanism 620 from rotating at an excessively high speed, accelerating the wear and aging of the internal structure of the filtering device 600 and shortening the life of the filtering device 600.

In a further solution of this embodiment, before starting the circulation pump 400, the process further includes: if the water level in the water tank 100 is greater than the preset water level, then start the circulation pump 400; otherwise, wait for the water level in the water tank 100 to reach the preset water level before starting the circulation pump 400.

The laundry treatment agent is generally added during the water filling process of the washing machine. In this embodiment, the circulation pump 400 is turned on after the washing machine completes the addition of the laundry treatment agent. However, since the washing machine generally has not completed the water filling process at this time, the actual water level in the water tank 100 has not yet reached the set washing/rinsing water level. In this embodiment, the actual water level in the water tank 100 is judged before turning on the circulation pump 400, and the circulation pump 400 is turned on only when the actual water level reaches the preset water level, which can prevent the water in the water tank 100 from being too small and causing the circulation pump to fail. The air sucked inside the 400 produces operating noise.

In this embodiment, after the circulation pump 400 is turned on, the washing machine determines the value of the first set speed and the value of the preset time according to the laundry parameters in the currently running laundry program; the driving mechanism 660 is turned on to drive the filtering mechanism 620 to rotate at the first set speed.

In detail, as shown in FIG. 3, the control method for the washing machine in this embodiment includes the following steps:

S1. delivering the clothing treatment agent;

S2. turning on the circulation pump after the delivery of the laundry treatment agent is completed;

S3. determining the operating parameters of the driving mechanism according to the washing parameters, including the value of the first set speed and the value of the preset time;

S4. turning on the driving mechanism and driving the filtering mechanism to rotate at the first set speed;

S5. when the preset time is reached, the driving mechanism is turned off and the filtering mechanism stops rotating.

The washing machine of this embodiment performs the above steps S1 to S5 in sequence during the water inlet stage when the laundry treatment agent needs to be added. After the water inlet is completed, circulating filter washing/rinsing is performed, including performing a circulating filter operation: the circulation pump 400 remains on and water is returned. The return water control valve 231 remains open, and the water in the water tank 100 returns to the water tank 100 after being filtered by the filtering device 600.

In another solution of this embodiment, step S1 can also be performed during the water filling process, and steps S2 to S5 can be performed in sequence after the water filling is completed. After the execution of step S5 is completed, the washing machine performs circulating filter washing/rinsing.

In this embodiment, the filtering cavity 610 of the filtering device 600 is also provided with a sewage outlet 6103, which is connected to the outer cavity of the filtering cavity 610 and is used to discharge filter impurities such as wire scraps to the outside. The sewage outlet 6103 is connected to the sewage pipeline 240, and the sewage pipeline 240 is provided with a sewage control valve 241 to control its on-off.

After washing/rinsing is completed, the washing machine performs a self-cleaning operation to remove filter impurities such as lint and other lint attached to the filtering mechanism 620 so that the lint is integrated into the water in the filtering cavity 610. When performing the self-cleaning operation, the circulation pump 400 can be turned off, and the sewage control valve 241 can be controlled to remain closed so that the water in the filtering cavity 610 does not flow out. The circulation pump 400 can also be controlled to remain open, and the sewage control valve 241 can be opened to introduce the water in the water tank 100 into the filtering device 600 to flush and clean the outer wall of the filtering mechanism 620, and then discharge it through the sewage outlet 6103.

Figure 5:
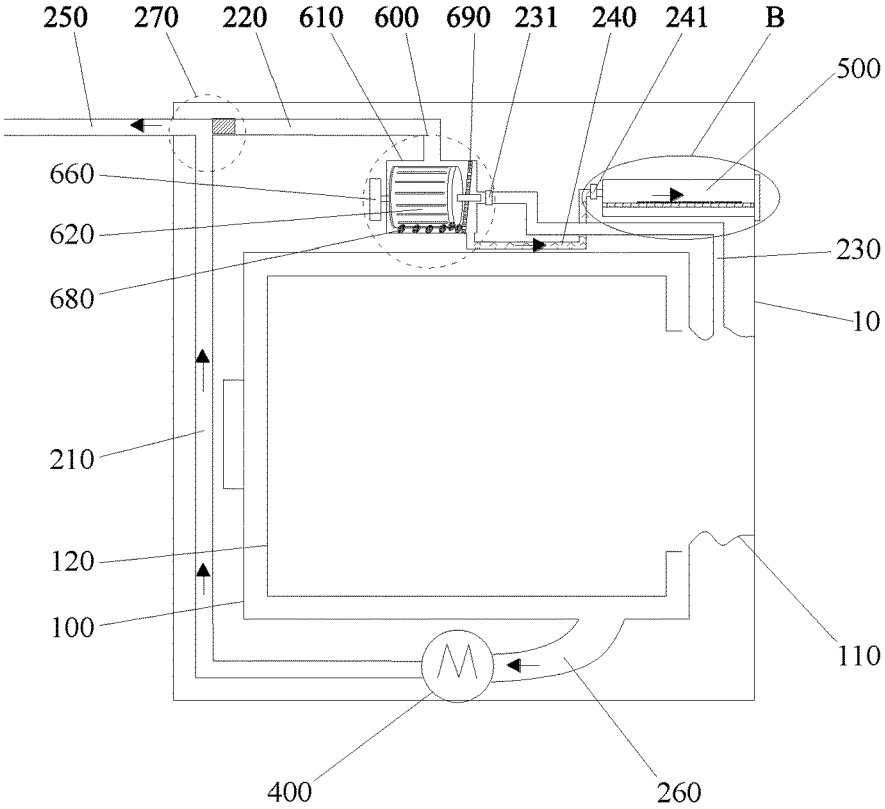
FIG. 5 is a schematic diagram of a washing machine performing a sewage discharge operation in an embodiment of the present disclosure.
Figure 6:
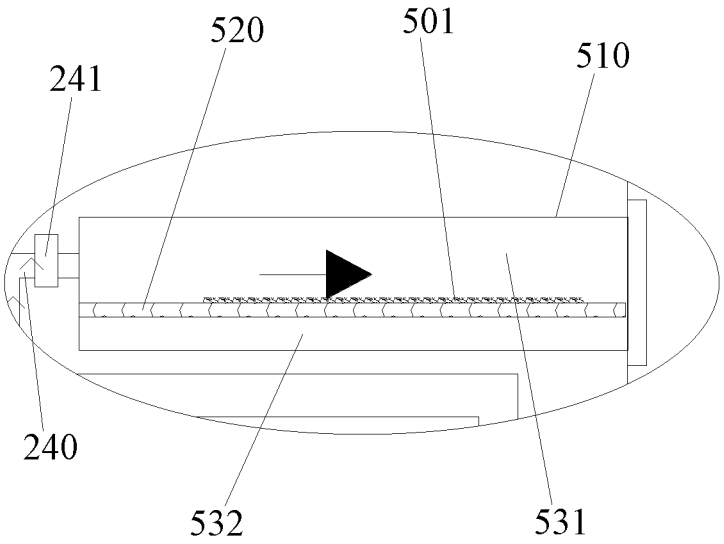
FIG. 6 is an enlarged schematic view of B in FIG. 5 of the present disclosure.

As shown in FIGS. 5 and 6, after the self-cleaning operation is completed, the washing machine also performs a sewage discharge operation, including: the return water control valve 231 is closed, the sewage control valve 241 is opened to connect the sewage pipeline 240, and the sewage carrying debris in the filtering device 600 is discharged through the sewage outlet 6103.

Through the above process, the filtering device 600 can accelerate the dissolution process of the clothes treatment agent after the clothes treatment agent is put into the washing machine, circulate and filter the water in the water tank 100 during the washing/rinsing process, remove lint in the water, and perform the washing/rinsing process. After rinsing, the attached lint is automatically cleaned and discharged, so that the next cycle of filtration can be carried out.

In a further solution of this embodiment, the washing machine further includes a recovery device 500 that is connected to the outlet end of the sewage pipeline 240 and is used to collect filtered impurities 501 such as discharged lint.

In the above solution, the recovery device 500 is provided to collect the filtered impurities 501 discharged from the filtering device 600, so that the filtered impurities 501 will not enter the drainage water flow and be discharged from the washing machine along with the drainage water flow. Through the above method, the fine thread debris in the filter impurity 501 is prevented from being discharged with the water flow and entering the ecological cycle, thereby causing harm to the ecological environment and human health.

In the specific solution of this embodiment, the recovery device 500 includes:

a housing 510 with a recovery chamber inside;

a filter component 520, being disposed in the recovery chamber and divides the recovery chamber into a first chamber 531 and a second chamber 532.

The sewage outlet 6103 is connected to the first chamber 531. The sewage carrying filtered impurities 501 enters the first chamber 531, is filtered by the filter component 520, and then enters the second chamber 532. The filtered impurities 501 are collected in the first chamber 531.

Specifically, the filter component 520 can be a frame horizontally arranged at a certain height in the recovery chamber and a filter screen laid on the frame. After the sewage carrying filtered impurities 501 enters the first chamber 531, the water can enter the second chamber 532 through the filter component 520. The filtered impurities 501 are blocked by the filter screen and remain on the upper surface of the filter component 520.

In the above solution, a filter component 520 is provided in the recovery device 500 to filter the received sewage and separate the filtered impurities 501 therein from the water. The interior of the recovery device 500 is divided into a first chamber 531 and a second chamber 532 through the filter component 520. The filter impurities 501 in the sewage are blocked by the filter component 520, thereby collecting the filter impurities 501 in the upper surface of filter component 520 in the first chamber 531, the filtered clean water is collected in the second chamber 532. Users can directly collect and process the separated filter impurities 501, avoiding the situation where the filter impurities 501 are dispersed in water and are difficult to process.

In this embodiment, the washing machine further includes a box body 10 in which the water tank 100 and the filtering device 600 are disposed. The housing 510 can be inserted/extracted from the box body 10 and the user can pull the housing 510 out of the box body 10 to clean the inside.

Specifically, the upper side of the housing 510 has an opening. When the user pulls the housing 510 out of the box body 10, the filter impurities 501 attached to the upper surface of the filter component 520 can be cleaned through the opening on the upper side of the housing 510. The filter component 520 is preferably detachably connected to the housing 510. The user can detach the filter component 520 from the inside of the housing 510 and take it out for cleaning, which makes the operation more convenient.

In a preferred solution of this embodiment, a water outlet is provided on the second chamber 532 for discharging filtered clean water. By arranging a water outlet in the second chamber 532, the clean water entering the second chamber 532 can be discharged from the recovery device 500 in a timely manner, thus preventing the recovery device 500 from overflowing when the amount of sewage discharged from the filtering device 600 is large. Otherwise, the capacity of the second chamber 532 needs to be increased, that is, the overall volume of the recovery device 500 needs to be increased, causing it to occupy a larger space inside the washing machine, which is not conducive to miniaturization of the overall volume of the washing machine.

On the other hand, the water in the second chamber 532 can be automatically discharged from the water outlet. When the user cleans the recovery device 500, he only needs to clean the filter impurities 501 on the filter component 520 without manually pouring out clear water of the second chamber 532. When the filter component 520 is detachably installed in the housing 510, the user does not even need to completely remove the housing 510 from the washing machine box body 10, but only needs to take out the filter component 520 for cleaning, which is more convenient to operate.

In a further solution of this embodiment, the drainage pipeline 210 and the circulation pipeline 220 are connected through a switching device 270. The switching device 270 is also connected to a discharge pipeline 250 and can control the selection of the circulation pipeline 220 and the discharge pipeline 250. It is connected to the drainage pipeline 210.

Specifically, the switching device 270 includes:

- a water inlet, which is connected to the water outlet end of the drainage pipeline 210;
- a first water outlet, which is connected to the water inlet end of the circulation pipeline 220;
- a second water outlet, which is connected to the water inlet end of the discharge pipeline 250;
- a switching mechanism controls the first water outlet and the second water outlet to selectively communicate with the water inlet.

The washing machine dissolves the laundry treatment agent through the filtering device 600, and when performing the circulation filtering operation and the self-cleaning operation, the switching device 270 conducts the drainage pipeline 210 and the circulation pipeline 220. After the self-cleaning operation is completed, the washing machine performs a sewage discharge operation, and also controls the switching device 270 to conduct the drainage pipeline 210 and the discharge pipeline 250. The circulation pump 400 is turned on and the remaining water in the water tank 100 is discharged from the washing machine.

Through the arrangement of the switching device 270, the pipeline connection structure inside the washing machine is simplified. At the same time, the circulation pump 400 can be used for both circulation filtration and washing machine drainage. There is no need to install two water pumps for different functions in the washing machine, which saves space and reduces production costs.

In this embodiment, the washing machine is provided with a circulating filter pipeline and a filtering device 600. The circulation pump 400 can drive the water in the water tank 100 to circulate through the filtering device 600 during the washing and rinsing processes of the washing machine, thereby reducing the content of lint in the water, and improving laundry performance. At the same time, the filtering device 600 can also accelerate the dissolution of the laundry treatment agent through the rotation of the filtering mechanism 620 after the laundry treatment agent is put in, so that the laundry treatment agent put into the water tank 100 can be more evenly and fully dissolved in the water, further improving laundry efficiency. The filtering device 600 has dual functions in one body, saving installation space inside the washing machine.

Embodiment 2

As shown in FIGS. 1 and 2, this embodiment is a further limitation of the above-mentioned Embodiment 1. Cleaning particles 680 are also provided in the filtering cavity 610 for friction and collision with the movement of the water flow to accelerate the dissolution of the laundry treatment agent.

In this embodiment, the cleaning particles 680 are provided in the filtering cavity 610. During the process of dissolving the laundry treatment agent, the filtering mechanism 620 rotates and agitates the water flow. At the same time, the cleaning particles 680 move with the water flow, causing friction and collision with each other or with the filtering cavity. The frictional collision between the inner wall of the body 610 and the outer wall of the filtering mechanism 620 can further enhance the agitation strength of the water flow in the filtering cavity 610, thereby further accelerating the dissolution rate of the laundry treatment agent.

On the other hand, during the circulation filtration process, the cleaning particles 680 can also clean the inner wall of the filtering cavity 610 and the outer wall of the filtering mechanism 620 through friction and collision to prevent filter impurities from depositing during the circulation filtration process, causing clogging of the filtering device 600 and affecting the filtration efficiency.

In this embodiment, the shape of the cleaning particles 680 includes but is not limited to spherical, ellipsoidal, elliptical cylindrical, etc. shapes. The surface of the cleaning particles 680 may be a smooth surface or a non-smooth surface. It is preferred that the cleaning particles 680 have a non-smooth surface, which can increase the friction between the cleaning particles 680 and the inner wall of the filtering cavity 610 and the outer wall of the filtering mechanism 620, and achieve a better effect of peeling off filtered impurities.

The material of the cleaning particles 680 is preferably a wear-resistant elastic material to prevent the cleaning particles 680 from being easily worn during use. The resilience of the cleaning particles 680 is preferably 0% to 50%. The cleaning particles 680 are made of elastic materials that are easily deformed when subjected to force, which can prevent the cleaning particles 680 from getting stuck during the rotation of the filtering mechanism 620 and even causing damage to the filtering device 600.

In a further solution of this embodiment, a blocking plate 690 is provided in the filtering cavity 610, the left side of the blocking plate 690 forms a first space, and the right side of the blocking plate 690 forms a second space. The water inlet 6101 and the cleaning particles 680 are located on the left side of the blocking plate 690, and the filtered water outlet 6102 and the sewage outlet 6103 are located on the right side of the blocking plate 690.

Figure 7:
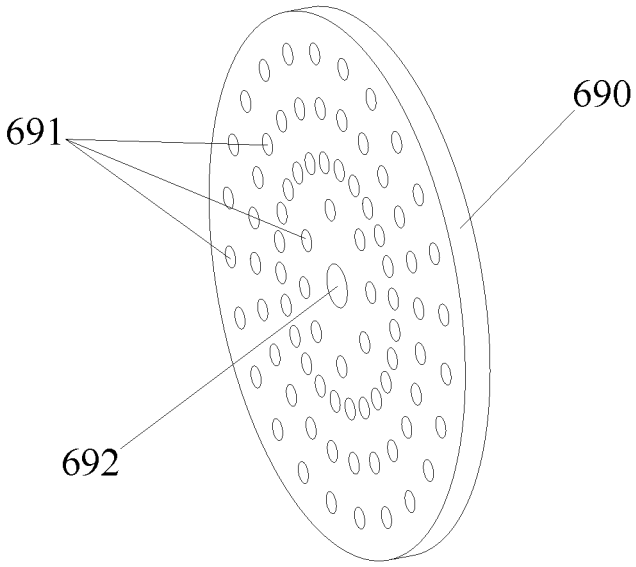
FIG. 7 is a schematic structural diagram of the blocking plate in Embodiment 2 of the present disclosure.

The specific structure of the blocking plate 690 is shown in FIG. 7, and a number of water holes 691 are provided on it. As shown in FIGS. 1 and 2, the water hole 691 connects the first space and the second space, but the cleaning particles 680 are restricted in the first space by the blocking plate 690 and do not enter the second space. This avoids the cleaning particles 680 being discharged with the water flow from the filtered water outlet 6102 or the sewage outlet 6103, or accumulating at the filtered water outlet 6102 or the sewage outlet 6103 to cause blockage.

Specifically, the outer periphery of the blocking plate 690 is in close contact with the inner wall of the filtering cavity 610, the width of the water hole 691 is $D_1$, the width of the cleaning particles 680 is d, and $D_1<d$.

The water hole 691 in this embodiment is a circular hole, and the width $D_1$ of the water hole 691 is the diameter of the water hole 691. It can be understood that the water hole 691 can also be arranged in other shapes, such as square holes, strip holes, etc., in which case the minimum size of the water hole 691 in different directions is the width $D_1$.

Similarly, for spherical cleaning particles 680, the width d of the cleaning particles 680 is the diameter of the cleaning particles 680. For cleaning particles 680 of other shapes, since the sizes of the cleaning particles 680 in different directions are not exactly the same, the smallest size among multiple different sizes is the width d. This ensures that the cleaning particles 680 cannot pass through the water holes 691 on the blocking plate 690 no matter how they change directions, thereby ensuring that the blocking plate 690 effectively blocks the cleaning particles 680.

In a further solution of this embodiment, the density of the cleaning particles 680 is smaller than that of water. After the water flow enters the filtering cavity 610, the cleaning particles 680 can float in the water, making it easier to be driven by the water flow in the first space of the filtering cavity 610, resulting in friction and collision, accelerating the uniform dissolution of the clothing treatment agent, or causing the filtered impurities to fall off. This avoids the situation where the cleaning particles 680 are deposited at the bottom of the filtering cavity 610 and cannot play an effective role when the impact force of the water flow is insufficient.

In a further solution of this embodiment, the outer circumference of the filtered water outlet 6102 extends toward the outside of the filtering cavity 610 to form a sealing support part 611.

The filtering mechanism 620 includes:

- a filtering part, which is located on the same side of the blocking plate 690 as the water inlet 6101, and filters the water entering the first space;
- a water outlet joint 621, the left end of which is connected to the filtering part, the right end passes through the blocking plate 690, and is rotatably inserted into the sealing support part 611.

The blocking plate 690 is provided with a through hole 692 for the water outlet joint 621 to pass through, and the through hole 692 has a clearance fit with the outer wall of the water outlet joint 621.

In the above solution, the water outlet joint 621 is rotatably and sealingly connected to the sealing support part 611, and the filtered water flows out through the water outlet joint 621. The blocking plate 690 is provided with a through hole 692 that fits the outer wall of the water outlet joint 621 with a clearance. The outer wall of the water outlet joint 621 does not contact the inner wall of the through hole 692 to prevent friction and resistance between the blocking plate 690 and the water outlet joint 621 when the filtering mechanism 620 rotates, which affects the smooth rotation of the filtering mechanism 620.

In this embodiment, cleaning particles 680 are provided inside the filtering cavity 610 and can move with the water flow during the rotation of the filtering mechanism 620, thereby further strengthening the agitation of the water flow and allowing the laundry treatment agent to dissolve in the water faster. At the same time, during the circulating filtration process, the cleaning particles 680 can rub and collide with the water flow to clean the inner wall of the filtering cavity 610 and the outer wall of the filtering mechanism 620, preventing filter impurities from depositing during the filtration process, ensuring the filtration efficiency, and at the same time, the filter impurities fall off more easily as the filtering device 600 performs automatic self-cleaning.

Embodiment 3

Figure 8:
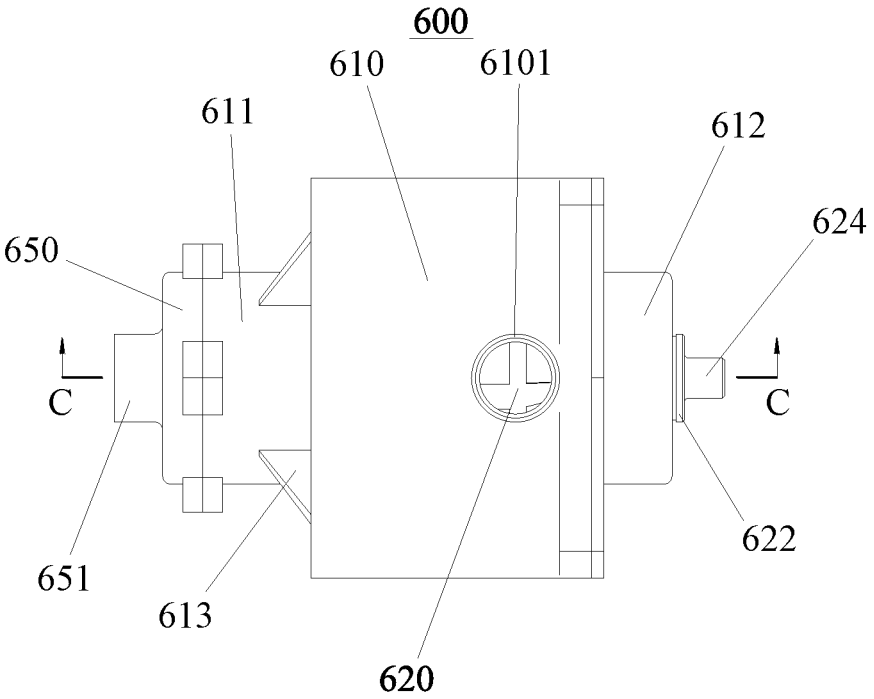
FIG. 8 is a schematic structural diagram of the filtering device in Embodiment 3 of the present disclosure.
Figure 9:
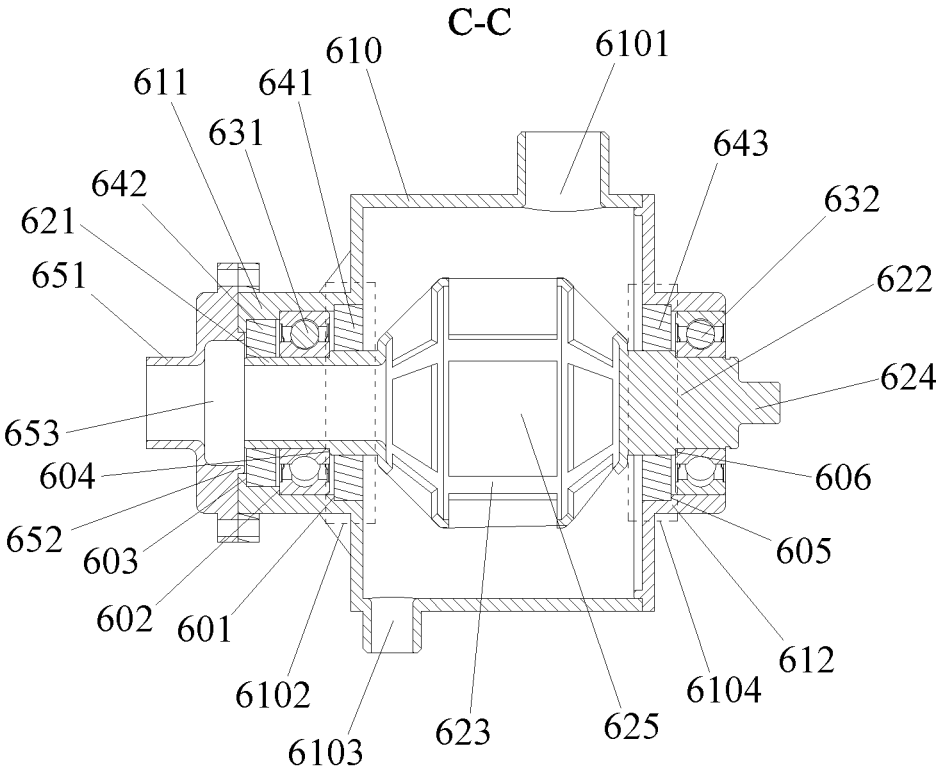
FIG. 9 is a schematic view of the CC section in FIG. 8 of the present disclosure.

As shown in FIGS. 8 and 9, this embodiment is a further limitation of the filtering device 600 in the Embodiment 1 or 2. The outer circumference of the filtered water outlet 6102 extends to the outside of the filtering cavity 610 to form a sealing support part 611. One end of the filtering mechanism 620 has a water outlet joint 621 inserted in the sealing support part 611. The water outlet joint 621 is rotatably and sealingly connected to the sealing support part 611.

The filtering device 600 also includes:

- a first bearing 631, which is sleeved on the water outlet joint 621;
- a first seal 641, which is disposed on the side of the first bearing 631 facing the inside of the filtering cavity 610 to block the gap between the water outlet joint 621 and the sealing support part 611.

In detail, the filtering mechanism 620 includes a filter holder and a filter screen 625, where the filter holder includes:

- a filter support part 623, which is located inside the filtering cavity 610, and the filter 625 covers the surface of the filter support part 623;

a water outlet joint 621, which is provided at the left end of the filter support part 623;

a rotating support part 622, which is provided at the right end of the filter support part 623 and is rotatably connected to the filtering cavity 610.

In the above solution, a first bearing 631 is provided between the water outlet joint 621 and the sealing support part 611 to support the water outlet joint 621, so that the water outlet joint 621 rotates more smoothly in the sealing support part 611, and at the same time, the structure is stable, which can ensure the filtering mechanism 620 rotates stably in the filtering cavity 610. The first seal 641 is provided on the right side of the first bearing 631 so that the washing water in the filtering cavity 610 cannot enter the gap between the water outlet joint 621 and the seal support part 611, thus preventing the first bearing 631 from contacting water and avoiding the failure of the first bearing 631, which ensures the effect of the first bearing 631. At the same time, the first seal 641 also prevents unfiltered wash water from flowing out from the filtered water outlet 6102 through the sealing support part 611 and affecting the efficiency of the filtering device 600 in removing lint.

In the specific solution of this embodiment, the first seal 641 is sleeved on the water outlet joint 621, the inner wall of the first seal 641 is sealingly connected to the outer wall of the water outlet joint 621, and the outer wall of the first seal 641 is connected to the inner wall of the sealing support part 611 rotatablly.

In a further solution of this embodiment, the filtering device 600 also includes a second seal 642. The second seal 642 is disposed on the side of the first bearing 631 facing away from the inside of the filtering cavity 610, blocking the gap between the water outlet joint 621 and the sealing support part 611.

Specifically, the second seal 642 is sleeved on the water outlet joint 621, the inner wall of the second seal 642 is sealingly connected to the outer wall of the water outlet joint 621, and the outer wall of the second seal 642 is rotatably connected with the inner wall of the sealing support part 611.

In the above solution, a second seal 642 is also provided on the left side of the first bearing 631. The water flowing out through the water outlet joint 621 can be blocked by the second seal 642 and will not contact the first bearing 631. The first bearing 631 is located between the first seal 641 and the second seal 642, which ensures that the installation environment of the first bearing 631 is water-free to the greatest extent, preventing the first bearing 631 from rusting when exposed to water and affecting the rotation smoothness of the filtering mechanism 620.

In a further solution of this embodiment, the inner wall of the sealing support part 611 has a stepped structure. From one end of the sealing support part 611 to the outside of the filtering cavity 610, a first limiting surface 601, a second limiting surface 602 and a third limiting surface 603 with an annular structure and gradually decreasing inner diameters are formed.

The surface of the first seal 641 facing the outside of the filtering cavity 610 is in contact with the first limiting surface 601. The surface of the first bearing 631 facing the outside of the filtering cavity 610 is in contact with the second limiting surface 602. The surface of the second seal 642 facing the outside of the filtering cavity 610 is in contact with the third limiting surface 603.

In the above solution, a plurality of vertical annular limiting surfaces are formed by the inner wall of the sealing support portion 611 with a stepped structure, respectively abutting the left side surfaces of the first seal 641, the first bearing 631 and the second seal 642, which can limit the movement of the above three in the axial direction of the water outlet joint 621, and prevent the matching structure between the water outlet joint 621 and the sealing support part 611 from loosening during the rotation of the filtering mechanism 620.

In the preferred solution of this embodiment, the outer diameter of one end of the water outlet joint 621 close to the outside of the filtering cavity 610 is smaller than the outer diameter of the other end. A fourth limiting surface 604 with an annular structure is formed on the outer wall of the water outlet joint 621 and is perpendicular to the axis of the water outlet joint 621. The surface of the first bearing 631 facing the inside of the filtering cavity 610 is in contact with the fourth limiting surface 604.

By arranging the outer diameter of the left end of the water outlet joint 621 to be smaller than the right end, a fourth limiting surface 604 toward the left is formed at the sudden change in the outer diameter, and is in contact with the right surface of the first bearing 631. In this way, both sides of the first bearing 631 have limiting structures, making the structure more stable.

In this embodiment, the end of the sealing support part 611 away from the filtering cavity 610, that is, the left end of the sealing support part 611 is connected to the filtering cavity flange 650. The filtering cavity flange 650 has a through hole 653 in the middle that communicates with the water outlet joint 621. The outer periphery of the through opening 653 extends away from the sealing support part 611 to form a connection part 651.

Preferably, the surface of the filtering cavity flange 650 facing the sealing support part 611 has a raised insertion part 652, and the insertion part 652 is inserted into the opening at the left end of the sealing support part 611.

In the above solution, the left end of the sealing support part 611 is connected to the filtering cavity flange 650, and a connection part 651 is formed on the filtering cavity flange 650. The outer diameter of the connection part 651 is smaller than the outer diameter of the sealing support part 611, and preferably the inner diameter of the connection part 651 is equal to the inner diameter of the water outlet joint 621. When the filtering device 600 is installed in the washing machine, it is connected to the return water pipeline through the connection part 651. Compared with the method in which the return water pipeline is directly connected to the left end of the sealing support part 611, the installation is easier.

The right side of the filtering cavity flange 650 has an insertion part 652 inserted into the left end opening of the sealing support part 611 to facilitate positioning when the filtering cavity flange 650 and the sealing support part 611 are assembled. A number of fixing parts are respectively provided on the outer periphery of the filtering cavity flange 650 and the sealing support part 611, and screws are passed through the fixing parts to realize the fixation of the filtering cavity flange 650 and the sealing support part 611.

In a further solution of this embodiment, the outer wall of the sealing support part 611 is provided with reinforcing ribs 613 extending in the radial direction of the sealing support part 611, and the reinforcing ribs 613 are connected to the surface of the filtering cavity 610 where the filtered water outlet 6102 is located.

Since the sealing support part 611 extends to a certain length from the left end surface of the filtering cavity 610, the reinforcing ribs 613 are provided to support its peripheral side wall from the outside, ensuring the strength of the sealing support part 611.

In a further solution of this embodiment, the rotation support portion 622 at the right end of the filtering mechanism 620 extends along its rotation axis toward the outside of the filtering cavity 610. The filtering cavity 610 is provided with an installation opening 6104 for the rotation support portion 622 to pass through. The rotating support part 622 is rotatably and sealingly connected to the installation opening 6104.

The rotating support part 622 is used to connect the driving mechanism that drives the filtering mechanism 620 to rotate. The rotating supporting part 622 extends from the right end of the filtering cavity 610, and a motor mounting part 624 is provided at the right end of the rotating supporting part 622 for connecting with the driving mechanism. Therefore, the driving mechanism can be arranged outside the filtering cavity 610 to avoid contact with water.

Further, the outer periphery of the installation opening 6104 extends along the axis of the rotating support part 622 to form a sleeve part 612 out of the filtering cavity 610. The third seal 643 is sleeved on the rotating support part 622. The inner wall of the third seal 643 is sealingly connected to the outer wall of the rotating support part 622, and the outer wall of the third seal 643 is rotatably sealingly connected to the inner wall of the sleeve part 612.

A second bearing 632 is also provided between the sleeve part 612 and the rotating support part 622. The second bearing 632 is sleeved on the rotating support part 622 and is located on the side of the third seal 643 facing the outside of the filtering cavity 610.

In the above solution, the arrangement of the third seal 643 prevents the water in the filtering cavity 610 from leaking from the installation opening 6104, and the arrangement of the second bearing 632 can support the rotating support part 622 to ensure that the rotating support part 622 is in contact with the sleeve. The relative rotation of the sleeve part 612 is smoother. The second bearing 632 is disposed on the right side of the third seal 643 and is not in contact with the water in the filtering cavity 610 to avoid failure.

In the preferred solution of this embodiment, the inner diameter of one end of the sleeve part 612 close to the outside of the filtering cavity 610 is smaller than the inner diameter of the other end. A fifth limiting surface 605 with an annular structure is formed on the inner wall of the sleeve part 612 and is perpendicular to the axis of the rotation support portion 622. The surface of the third seal 643 facing the outside of the filtering cavity 610 is in contact with the fifth limiting surface 605.

The outer diameter of one end of the rotating support part 622 close to the outside of the filtering cavity 610 is smaller than the outer diameter of the other end. A sixth limiting surface 606 with an annular structure and perpendicular to the axis of the rotating supporting part 622 is formed on the outer wall of the rotating support part 622. The surface of the second bearing 632 facing the inside of the filtering cavity 610 is in contact with the sixth limiting surface 606.

In the above solution, the inner diameter of the right end of the sleeve part 612 is smaller than the inner diameter of the left end, and a fifth limiting surface 605 toward the left is formed at a sudden change in the inner diameter to contact the right surface of the third seal 643. The outer diameter of the right end of the rotating support part 622 is smaller than the outer diameter of the left end, and a sudden change in the outer diameter forms a sixth limiting surface 606 toward the right, which contacts the left surface of the second bearing 632. The above structure limits the movement of the third seal 643 and the second bearing 632 in the axial direction of the rotating support part 622, and the structure is stable.

Furthermore, the cross-sectional area of the middle region of the filter support portion 623 is constant, and its left and right ends have tapered structures, so that the partial surface of the filter screen 625 is tilted, which is beneficial to the shedding of attached lint.

In this embodiment, the first bearing 631 and the second bearing 632 are respectively provided at both ends of the filtering mechanism 620 for support, ensuring that the filtering mechanism 620 rotates smoothly and stably in the filtering cavity 610. At the same time, through the arrangement of the first seal 641, the second seal 642 and the third seal 643, the installation environment of the first bearing 631 and the second bearing 632 is guaranteed to be water-free to the greatest extent, preventing the first bearing 631 and the second bearing 632 from being in contact with water to avoid failure of both.

Embodiment 4

As shown in FIGS. 1 and 2, this embodiment provides a control method for a washing machine. The structure of the washing machine in this embodiment is the same as that of the washing machine in Embodiment 1 above.

Specifically, the control method includes:

- turning on the circulation pump 400, communicating the circulating filter pipeline, and the washing machine performs circulation filtering and rinsing;
- after rinsing is completed, the circulation pump 400 is turned off,
- turning on the driving mechanism 660 to drive the filtering mechanism 620 to rotate in the filtering cavity 610;
- when the first setting condition is reached, the circulation pump 400 is turned on, and the sewage control valve 241 is opened to communicate the sewage pipeline 240;
- when the second setting condition is reached, cut off the circulating filter pipeline.

Preferably, after the first setting condition is reached, the driving mechanism 660 remains open and drives the filtering mechanism 620 to continue rotating.

In this embodiment, the communication to the circulating filter pipeline includes: the switching device 270 conducts the water outlet end of the filtering device 600 and the circulation pump 400, and opens the return water control valve 231 to conduct the return water pipeline 230. The said cutting off the circulating filter pipeline includes: the switching device 270 conducts the discharge pipeline 250 and the water outlet end of the circulation pump 400.

It can be understood that the above-mentioned cutting off the circulation filtration pipeline can also be achieved by shutting down the circulation pump 400.

In this embodiment, the water inlet 6101 of the filtering device 600 is higher than the maximum water level of the washing machine. The washing machine performs circulating filtering of the rinse water during the rinsing process. The filtering device 600 and the circulating filter pipeline are always filled with rinse water.

After rinsing is completed and the circulation pump 400 is turned off, since the drainage pipeline 210 transports water from bottom to top, the circulation pipeline 220 and the filtering device 600 are set higher than the water tank 100, and the water in the drainage pipeline 210 and the circulation pipeline 220 is moved under the action of gravity. The downward return flow can be at most until the height of the water surface in the drainage pipe 210 is equal to the height of the water level in the water tank 100, and the pipeline between the water surface and the filtering device 600 is filled with air. However, the filtering device 600 is lower than the circulation pipeline 220, and the water therein will not flow back through the circulation pipeline 220. When the circulation pump 400 is closed, the return water control valve 231 is also closed, and the sewage control valve 241 is in a closed state at this time. The water inside the filtering device 600 remains in the filtering cavity 610 and will not be discharged outward.

After the driving mechanism 660 is turned on, it drives the filtering mechanism 620 to rotate at a high speed, so that the filtered impurities such as lint and other particles attached to the surface are peeled off from the surface of the filtering mechanism 620 under the action of centrifugal force. At this time, since the return water control valve 231 and the sewage control valve 241 are both closed, the water in the filtering cavity 610 does not flow out. The high-speed rotating filtering mechanism 620 can also stir the water flow in the filtering cavity 610, forming a turbulent water flow. It causes a certain impact force on the surface of the filtering mechanism 620, and also drives the cleaning particles 680 to move to frictionally collide with the inner wall of the filtering cavity 610 and the outer wall of the filtering mechanism 620, further enhancing the shedding of wire debris. The filtered impurities such as lint scraps peeled off from the surface of the filtering mechanism 620 are integrated into the water in the filtering cavity 610.

When the circulation pump 400 is turned on, the sewage control valve 241 is also opened to connect the sewage pipeline 240. The sewage in the filtering device 600 can be discharged from the sewage outlet 6103. The cleaning particles 680 are blocked by the blocking plate 690 and remain inside the filtering cavity 610. The opening of the circulation pump 400 presses the air in the drainage pipeline 210 and the circulation pipeline 220 into the filtering device 600, so that the sewage carrying lint in the filtering device 600 is completely discharged from the sewage outlet 6103 under the air pressure, preventing the sewage from remaining in the filtering device 600, which has a good cleaning effect on the filtering device 600. The sewage control valve 241 is opened when the circulation pump 400 is turned on, ensuring the pressure generated when air passes into the filtering device 600, thereby ensuring that the sewage in the filtering device 600 is fully discharged.

In order to prevent the water in the water tank 100 from entering the filtering device 600 through the circulation pipeline 220 after the sewage in the filtering device 600 is drained, the washing machine is preset with a second setting condition. When the second setting condition is reached, the circulation is cut off. The filter pipeline stops the water in the water tank 100 from being transported to the filtering device 600.

In a specific solution of this embodiment, the first setting condition may be that the circulation pump 400 is turned off for the first set time $t_1$, and the second set condition may be that the circulation pump 400 is turned on for the second set time $t_2$.

In the above solution, the specific values of the first set time $t_1$ and the second set time $t_2$ can be obtained in advance through a large number of experiments and directly written into the control program of the washing machine.

Specifically, the value of the first set time $t_1$ is approximately the maximum time required for the water level in the drainage pipeline 210 to begin to decrease until it stops, and the value of the second set time $t_2$ is approximately the shortest time required for the water level in the drainage pipeline 210 to rise to close to the top of the drainage pipeline 210 after the circulation pump 400 is turned on. In this way, it can be ensured that a larger amount of air can enter the pipeline when the circulation pump 400 is turned off, and at the same time, it can effectively prevent water from entering the filtering device 600 after the circulation pump 400 is turned on.

In another solution of this embodiment, the water level height can also be used as the first setting condition and the second setting condition. Specifically, the first setting condition is: the water level in the pipeline between the circulation pump 400 and the filtering device 600 reaches the first setting value $H_1$. The second setting condition is: the water level in the pipeline between the circulation pump 400 and the filtering device 600 reaches the second setting value $H_2$. Among them, $H_1<H_2$.

In this embodiment, the above-mentioned water level is specifically the water level height in the drainage pipeline 210. A water level detection device may be provided in the drainage pipeline 210 of the washing machine to detect the water level in the drainage pipeline 210.

In the above solution, the value of the first set value $H_1$ is greater than and as close as possible to the highest water level of the washing machine to ensure that after the circulation pump 400 is turned off, the water level in the drainage pipe 210 can drop to the first set value $H_1$.

When the washing machine receives a signal that the water level in the drainage pipe 210 rises to the second set value $H_2$ and when the switching device 270 turns on the drainage pipe 210 and the external discharge pipe 250. In order to avoid response delay causing water to enter the filtering device 600 after the circulation pump 400 is turned on, there needs to be a certain difference $\Delta H$ between the value of the second set value $H_2$ and the water level corresponding to the top of the drainage pipeline 210. The specific value of the difference $\Delta H$ can be obtained through a large number of experiments conducted in advance, thereby ensuring that after the washing machine receives the signal that the water level reaches the second set value $H_2$, it has sufficient response time to control the switching device 270 to complete the switch of the water path.

In a further solution of this embodiment, the washing machine determines that the current operation process is the last rinsing stage in this laundry program, then turns off the circulation pump 400 after the rinse is completed, and turns on the circulation pump 400 after reaching the first setting condition.

The washing machine determines that the current running process is not the last rinsing stage in this laundry program, and then performs the following operations after rinsing is completed:

the circulation pump 400 remains in operation;

when the third setting condition is reached, cut off the circulation filter pipeline.

In the above solution, for the intermediate rinsing stage, since the washing machine needs to continue to operate, that is, the rinsing water will circulate through the filtering device 600 for filtration. At this time, the sewage carrying lint in the filtering device 600 does not need to be drained. It is necessary to remove the lint attached to the surface of the filtering mechanism 620.

After rinsing is completed, the return water control valve 231 is closed, the sewage control valve 241 is opened, the circulation pump 400 remains in operation, and the water in the water tank 100 continues to be transported to the filtering device 600 under the action of the circulation pump 400, affecting the inside of the filtering device 600. Flushing is performed, and the flushed sewage is discharged into the sewage pipeline 240 through the sewage outlet 6103.

In this embodiment, the third setting condition may be the end of rinsing and the third preset time $t_3$, whose value is obtained through experiments in advance and written into the control program to ensure that the lint attached to the surface of the filtering mechanism 620 can be basically removed.

Alternatively, the circulation filtration pipeline can also be cut off when the water level in the water tank 100 drops to the preset value $\Delta H_1$, that is, the switching device 270 is controlled to connect the drainage pipeline 210 and the external discharge pipeline 250, and the circulation pump 400 continues to operate. The remaining water in the water tank 100 is drained out of the washing machine.

In the preferred solution of this embodiment, after the intermediate rinsing is completed, the driving mechanism 660 is turned on to drive the filtering mechanism 620 to rotate at a high speed in the filtering cavity 610, which can stir the water in the filtering cavity 610 and cause the attached lint to be stirred by centrifugal force and agitation. Under the dual action of the water flow, it is peeled off from the surface of the filtering mechanism 620, blends into the water in the filtering cavity 610, and is then discharged from the filtering cavity 610 through the sewage outlet 6103. The cleaning efficiency of the lint debris is high.

In this embodiment, the washing machine only performs the operation of first turning off the circulation pump 400 and then turning on the circulation pump 400 at the end of the last rinse, so as to completely drain the sewage in the filtering device 600. At the end of the intermediate rinsing, the circulation pump 400 remains in operation, which prevents the circulation pump 400 from being frequently turned on and off during the operation of the washing machine, which affects its service life.

In this embodiment, the washing machine also cleans the filtering device 600 after washing. The specific control method is as follows:

- the circulation pump 400 is turned on, the switching device 270 connects the water outlet of the circulation pump 400 and the filtering device 600, the return water control valve 231 is opened, and the washing machine performs circulation filtering and washing;
- after washing is completed, the circulation pump 400 remains running, the return water control valve 231 is closed, and the sewage control valve 241 is opened;
- when the fourth setting condition is reached, the switching device 270 connects the water outlet end of the circulation pump 400 and the discharge pipe 250.

The fourth setting condition may be that the washing is completed and the fourth preset time $t_4$ is reached, or that the water level in the water tank 100 drops to a preset value $\Delta H_2$.

After the washing is completed, circulation filter rinsing needs to be performed in the subsequent process of the laundry process. Similar to the intermediate rinsing, the sewage in the filtering device 600 does not need to be completely discharged. The circulation pump 400 can remain running and does not need to be shut down.

In this embodiment, after the washing and intermediate rinsing are completed, the washing machine controls the circulation pump 400 to keep running, and transports the water in the water tank 100 to the filtering device 600 for flushing. The flushed sewage is discharged from the sewage outlet 6103 of the filtering device 600. After the last rinse, first turn off the circulation pump 400, wait for air to enter the pipeline, and then restart the circulation pump 400 to press the air in the pipeline into the filtering device 600, thereby completely draining the sewage and ensuring that the washing machine stops running. There is no sewage residue in the post-filtration device 600, which can effectively prevent bacterial growth. At the same time, the washing machine only performs the operation of first turning off the circulation pump 400 and then turning it on after the last rinse, which reduces unnecessary opening and closing operations of the circulation pump 400 and extends the service life of the circulation pump 400.

The above are only preferred embodiments of the present invention, and do not limit the present invention in any form. Although the present invention has been disclosed above in preferred embodiments, it is not intended to limit the present invention. Anyone familiar with the technology of this patent Without departing from the scope of the technical solution of the present invention, personnel can make some changes or modify the above-mentioned technical contents into equivalent embodiments with equivalent changes. In essence, any simple modifications, equivalent changes and modifications made to the above embodiments still fall within the scope of the present invention.

The invention claimed is:

1. A control method for a washing machine, the washing machine comprising:

a water tank; and a circulating filter pipeline, a water inlet end and a water outlet end of the circulating filter pipeline are communicated to the water tank respectively, and a circulation pump and a filtering device are installed on the circulating filter pipeline, wherein the filtering device includes a filtering cavity with a water inlet and a filtered water outlet, wherein a filtering mechanism is rotatably installed inside the filtering cavity to filter water entering the filtering cavity, wherein the control method includes:

delivering a laundry treatment agent into the water tank;

turning on the circulation pump to circulate the water in the water tank through the filtering device;

controlling the filtering mechanism to rotate in the filtering cavity at a first set speed to dissolve the laundry treatment agent in the water, wherein the filtering mechanism continues to rotate at the first set speed for a preset time, and then the filtering mechanism is controlled to stop rotating, after the filtering mechanism stops rotating, the circulation pump remains in an operating state and the washing machine performs a circulation filtering washing/rinsing, and after washing/rinsing is completed, the filtering mechanism is controlled to rotate in the filtering cavity at a second set speed to remove filtered impurities on a surface of the filtering mechanism, wherein the first set speed is greater than the second set speed, and wherein the washing machine determines the first set speed according to washing parameters in the currently operating washing program.

2. The control method for the washing machine according to claim 1, wherein the washing machine determines a preset duration according to the washing parameters in the currently operating washing program.

3. The control method for the washing machine according to claim 2, wherein the washing parameters include a water level in the water tank, and/or the water temperature in the water tank, and/or whether the washing machine turns on the heating function.

4. The control method for the washing machine according to claim 2, wherein the preset duration is extended as the water level in the water tank increases; and/or, the preset duration shortens as the water temperature in the water tank increases; and/or, the preset duration is shortened when the washing machine turns on the heating function.

5. The control method for the washing machine according to claim 1, wherein, before turning on the circulation pump, the step further includes: if the water level in the water tank is greater than the preset water level, then turn on the circulation pump, otherwise turned on the circulation pump after the water level in the water tank reaches the preset water level.

6. The control method for the washing machine according to claim 1, wherein the filtering device further includes a driving mechanism, the driving mechanism is connected to the filtering mechanism and is used to drive the filtering mechanism to rotate in the filtering cavity;

after turning on the circulation pump, the washing machine determines the first set speed according to the washing parameters in the currently operating washing program; and the driving mechanism is turned on to drive the filtering mechanism to rotate at the first set speed.

7. The control method for the washing machine according to claim 1, wherein, the first set speed is 100~800 rpm.

8. The control method for the washing machine according to claim 1, wherein the washing parameters include a water temperature in the water tank and/or whether the washing machine turns on a heating function.

9. The control method for the washing machine according to claim 1, wherein the first set speed decreases as the water temperature in the water tank increases; and/or, the first set speed decreases when the washing machine turns on the heating function.

10. The washing machine which uses the control method for the washing machine according to claim 1.

11. The washing machine according to claim 10, wherein cleaning particles are provided in the filtering cavity for friction and collision with a movement of water flow to accelerate a dissolution of the clothing treatment agent.

* * * * *